United States Patent [19]

Mills

[11] 4,202,532

[45] May 13, 1980

[54] JOINTED STRUCTURE, COMBINATION OF MEMBERS THEREFOR, AND METHOD OF DISASSEMBLY THEREOF

[75] Inventor: Roy H. Mills, Toronto, Canada

[73] Assignee: Westeel-Rosco Limited
Westeel-Rosco Limitée, Toronto, Canada

[21] Appl. No.: 863,863

[22] Filed: Dec. 23, 1977

[30] Foreign Application Priority Data

Nov. 22, 1977 [CA] Canada ..... 291516

[51] Int. Cl.[2] ..... E04H 17/16

[52] U.S. Cl. ..... 256/24; 403/242

[58] Field of Search ..... 256/22, 21, 24, 59, 256/25, 26; 403/242, 263, 244; 81/3 R

[56] References Cited

U.S. PATENT DOCUMENTS

| | | | |
|---|---|---|---|
| 598,270 | 1/1898 | McCallum | 256/21 |
| 825,790 | 7/1906 | York | 81/3 R |
| 1,357,533 | 11/1920 | Vannam-Smith | 81/3 R |
| 1,984,607 | 12/1934 | Twickler | 126/309 |
| 2,098,717 | 11/1937 | Calgins et al. | 189/36 |
| 2,638,025 | 5/1953 | Nelson | 81/3 R |
| 3,037,593 | 6/1962 | Webster | 52/618 X |
| 3,071,780 | 1/1963 | Lyon, Jr. | 4/187 |
| 3,293,812 | 12/1966 | Hammitt | 52/492 X |
| 3,594,028 | 8/1969 | Scott | 52/471 X |
| 3,713,679 | 1/1973 | Beschman | 52/262 X |
| 3,744,826 | 7/1973 | Hawes | 52/620 X |

FOREIGN PATENT DOCUMENTS

| | | | |
|---|---|---|---|
| 576304 | 5/1959 | Canada . | |
| 748100 | 12/1966 | Canada . | |
| 544300 | 9/1922 | France | 81/3 R |
| 1170546 | 11/1969 | United Kingdom . | |
| 1219336 | 1/1971 | United Kingdom . | |
| 1247987 | 9/1971 | United Kingdom . | |
| 1275511 | 5/1972 | United Kingdom . | |
| 1343710 | 1/1974 | United Kingdom . | |
| 1405912 | 9/1975 | United Kingdom . | |

*Primary Examiner*—Werner H. Schroeder
*Attorney, Agent, or Firm*—Ridout & Maybee

[57] ABSTRACT

In a fence structure comprising upper and lower horizontal rails between which fence panels are disposed each of the fence panels is connected to each of the rails by a jointed structure, the jointed structure comprising a resiliently deformable V-shaped lip a first limb of which is presented by the fence panel and the second limb of which has a free edge, with the lip disposed, with the second limb resiliently deformed towards the first limb, within a recess in the associated rail. The lip is in contact with a bottom wall of the recess with a space provided between this bottom wall and the second limb of the lip, the free edge of which is in biting engagement with one side wall of the recess at a spaced distance from the bottom wall thereof, with the first limb of the lip in bearing contact with the other side wall of the recess. There is also disclosed a method of disassembling each fence panel from each rail of the fence structure by disposing a projection at one end of a joint disassembly tool within the recess in the rail adjacent to the lip to be removed, sliding the projection along the recess into the space between the bottom wall of the recess and the second limb of the lip, and prying this second limb with the projection resiliently to deform the second limb towards the first limb of the lip. The lip is then removed from the recess in the rail.

8 Claims, 6 Drawing Figures

JOINTED STRUCTURE, COMBINATION OF MEMBERS THEREFOR, AND METHOD OF DISASSEMBLY THEREOF

This invention is concerned according to one aspect thereof with the provision of a combination of members for forming a jointed structure which may, for example, be incorporated in a fence structure, the combination of members comprising first and second members, with the first member being provided with a recess, and the second member presenting a resiliently deformable lip which is adapted by resilient deformation thereof to enter said recess in the first member with a space being provided between the lip and a bottom wall of the recess.

While it has hitherto been proposed to provide such a combination of members, it is a primary object of said one aspect of the present invention to provide such a combination which is of improved form and which provides increased resistance against accidental disassembly of the members when the members are operatively assembled as a jointed structure.

According to said one aspect of the present invention there is provided, in combination, a first member having a recess bounded by a bottom wall, a first side wall, and a second side wall, and a second member presenting a resiliently deformable V-shaped lip one limb of which is presented by the second member and the other limb of which has a free edge, the lip being adapted by resilient deformation of said other limb of the lip towards said one limb of the lip to enter the recess in the first member and to attain a position therein in which the lip is in contact with the bottom wall of the recess with a space provided between said other limb of the lip and the bottom wall of the recess, and with said one limb in bearing contact with the first side wall and the free edge of said other limb in biting engagement with the second side wall at a spaced distance from the bottom wall at a spaced distance from the bottom wall of the recess.

The invention is also concerned according to a further aspect thereof with a jointed structure, and it is an object of this further aspect of the invention to provide a jointed structure comprising a combination of first and second members according to said one aspect of the invention, with these members being in their assembled condition.

In order that the invention may be more clearly understood and more readily carried into effect the same will now, by way of example, be more fully described with reference to the accompanying drawings in which FIG. 1 is an isometric, broken-away view of a fence structure incorporating jointed structures according to a preferred embodiment of said further aspect of the invention;

Figure 1:
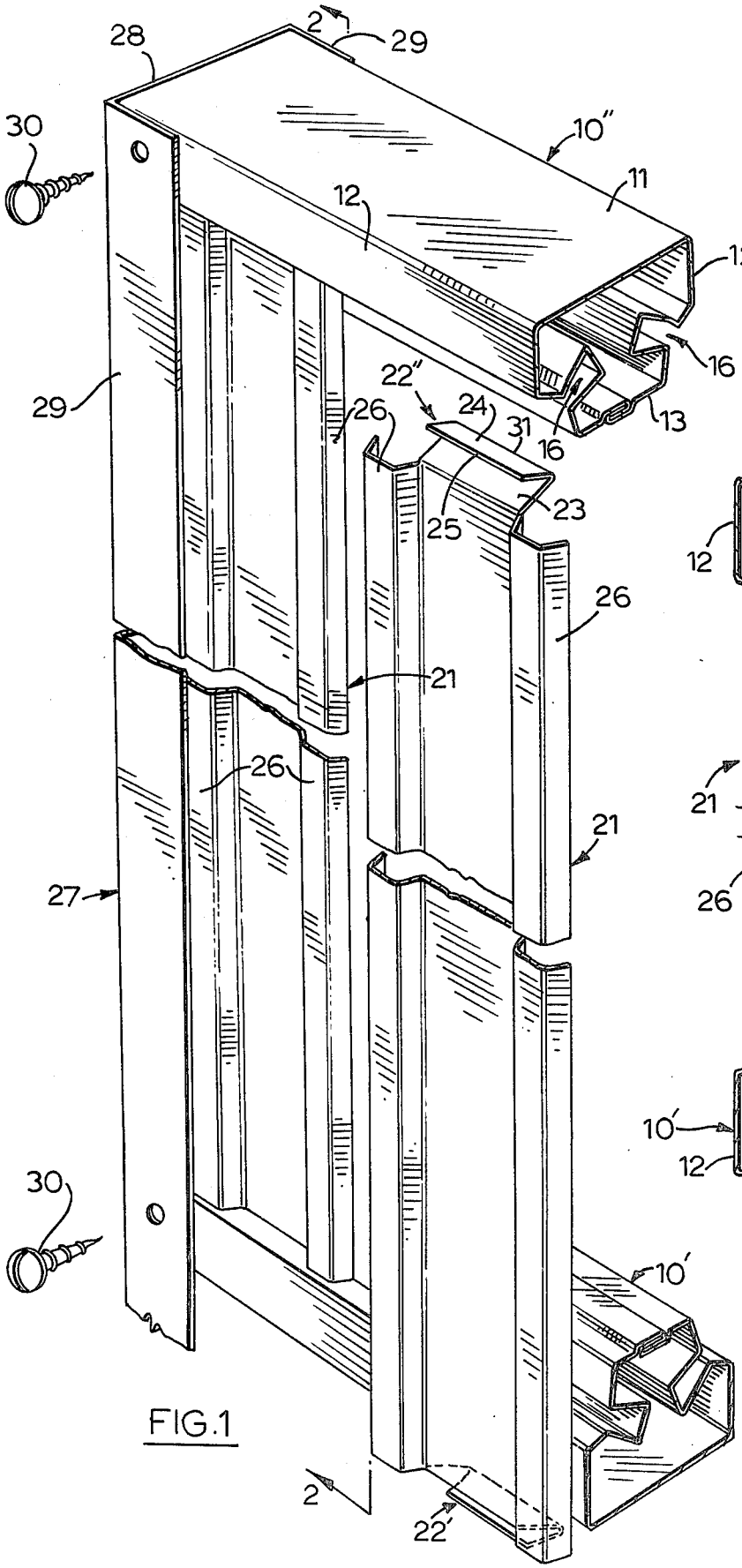
Figure 2:
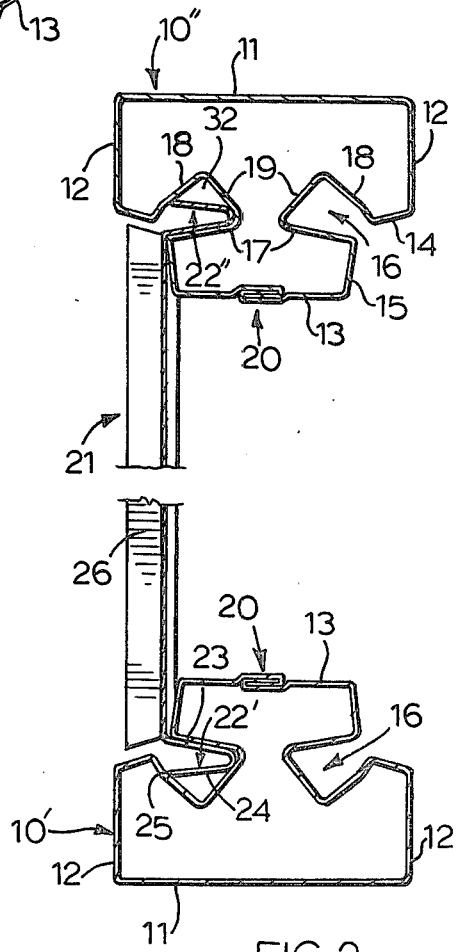
FIG. 2 is a vertically sectioned view on the line 2—2 in FIG. 1.

Referring to the drawings, 10′ denotes generally a lower, substantially horizontal rail, and 10″ denotes generally an upper, substantially horizontal rail which is spaced above the lower rail 10′. The rails 10′ and 10″ are, in the preferred embodiment illustrated, of identical form, and each comprises a first main wall 11, side walls 12, and a second main wall 13. Each side wall 12 has wall portions 14 and 15 between which there is provided a recess 16 bounded by a first side wall 17, a second side wall 18, and a bottom wall 19. In the lower rail 10′ the main wall 13 is uppermost with the main wall 11 lowermost, while in the upper rail 10″ the main wall 11 is uppermost with the main wall 13 lowermost, the rails 10′ and 10″ being, in the preferred embodiment illustrated, formed from a strip of sheet metal the side edge portions of which are interconnected along the length of the main wall 13 in a conventional manner as indicated by the reference numeral 20, so that each of the rails 10′ and 10″ is thus of hollow form.

21 denotes generally each of a plurality of fence panels each of which presents at the lower end thereof a resiliently deformable lip 22′ and each of which presents at the upper end thereof a resiliently deformable lip 22″. In the preferred embodiment illustrated, the lips 22′ and 22″ are of identical construction, and each is preferably V-shaped with one limb 23 of each lip 22′ and 22″ being presented by the associated panel 21 and the other limb 24 of each lip 22′ and 22″ having a free edge 25, each of the fence panels 21 which has vertically extending side portions 26 of channel form preferably being of sheet metal construction.

In assembling the fence structure, the rails 10′ and 10″ are formed into a frame with end posts 27 to which the rails 10′ and 10″ are connected and one of which is shown in FIG. 1, the posts 27 being fixedly mounted by, for example, the lower end portions thereof being disposed within holes dug in the ground with the holes then being filled with concrete, as is conventional practice. As shown in FIG. 1 each post 27 is in the preferred embodiment illustrated, of channel form, and comprises a web wall 28 against which the associated ends of the lower rail 10′ and the upper rail 10″ abut, and side walls 29 which embrace the associated end portions of the lower rail 10′ and the upper rail 10″ and which are substantially in contact with the side walls 12 thereof, the connection between the end posts 27 and the rails 10′ and 10″ comprising, for example, sheet metal screws 30 which are operatively disposed through the side walls 29 of the end posts 27 and through the associated side walls 12 of the rails 10′ and 10″.

The fence panels 21 are then mounted between the lower rail 10′ and the upper rail 10″ in order to complete the fence structure, the panels 21 being, as desired, all mounted on one or other side of each of the rails 10′ and 10″ in order to provide a single-faced fence structure, or mounted on both sides of the rails 10′ and 10″ in order to provide a double-faced fence structure. Generally, if a single-faced fence structure is desired a small, uniform space will be provided between the adjacent fence panels 21, although if it is desired the adjacent fence panels 21 could be mounted in abutting contact with one another. Where a double-faced fence structure is desired the adjacent fence panels 21 on each side of the rails 10′ and 10″ will generally be spaced apart a somewhat greater but uniform distance, with the fence panels 21 on opposite sides of the rails 10′ and 10″ being in staggered relationship, the spacing between the adjacent fence panels 21 on each side of the rails 10′ and 10″ preferably being less than the width of each fence panel 21 so that there is overlapping between the fence panels 21 on opposed sides of the rails 10′ and 10″, thereby to provide a so-called "privacy" fence structure.

Figure 3:
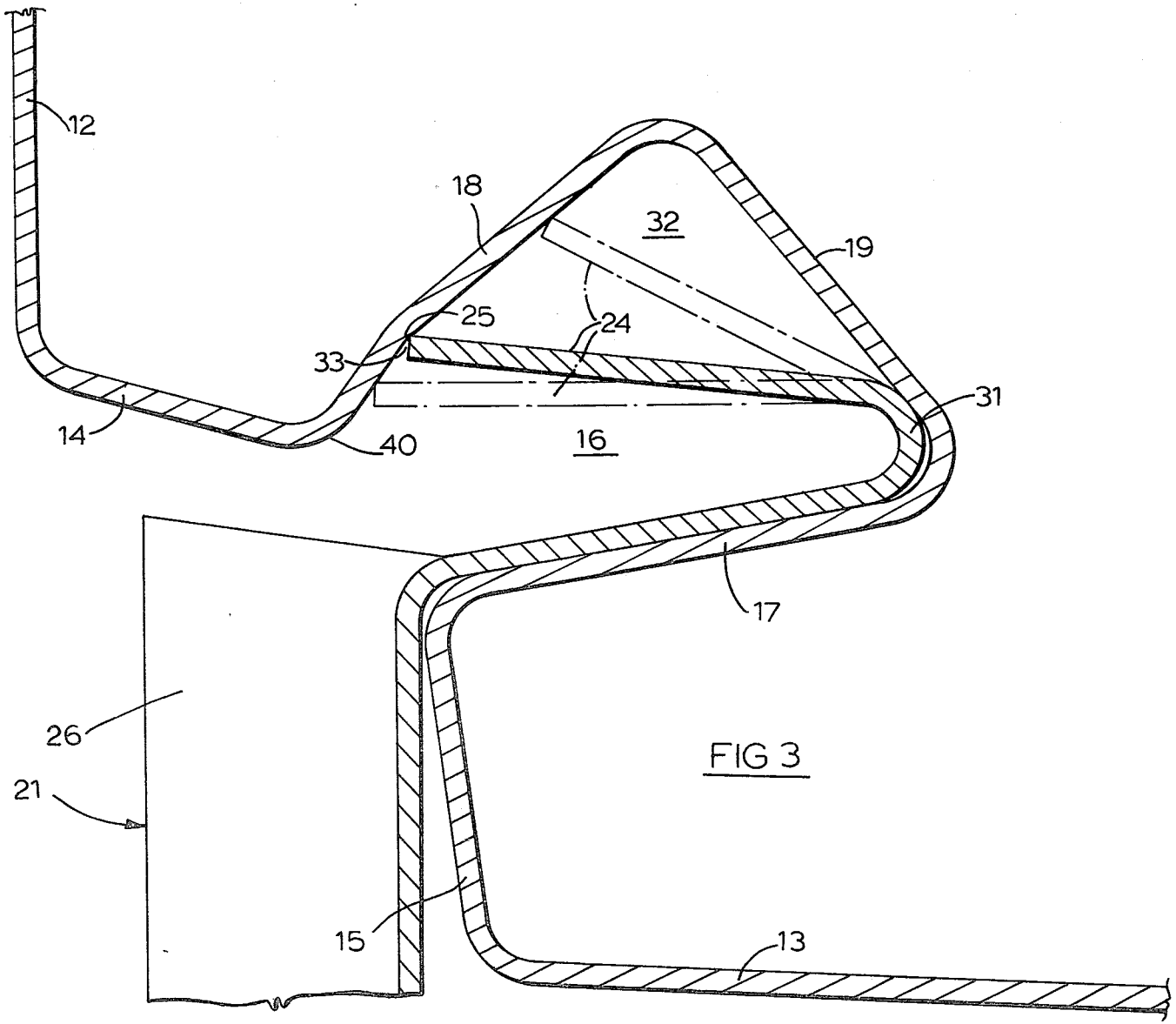
FIG. 3 is a sectioned view, on an enlarged scale, of a portion of the structure shown in FIG. 2.

In order to mount each fence panel 21 on the rails 10′ and 10″ the lower lip 22′ is disposed within the recess 16 in the appropriate side wall 12 of the lower rail 10′ to form a jointed structure comprising a first member constituted by the lower rail 10′ and a second member constituted by the fence panel 21, and the upper lip 22″ is disposed within the recess 16 in the appropriate side wall 12 of the upper rail 10″ to form a corresponding further jointed structure comprising a first member constituted by the upper rail 10″ and a second member constituted by the fence panel 21, the upper lip 22″ preferably being first so mounted on the upper rail 10″ with the lower lip 22′ then being so mounted on the lower rail 10′. To mount the upper lip 22″ on the upper rail 10″ the lip 22″ is urged into the recess 16 in the appropriate side wall 12 of the upper rail 10″, during which the limb 24 of the lip 22″ is resiliently deformed towards the limb 23 thereof. The first wall 17 and the second wall 18 of each recess 16 are divergent in the direction towards the bottom wall 19 thereof so that, during the urging of the lip 22″ into the recess 16, once the free edge 25 of the limb 24 enters the recess 16 the limb 24 moves away from the limb 23 under the influence of the inherent resiliency of the lip 22″ thereby maintaining the free edge 25 of the limb 24 in bearing contact with the side wall 18 of the recess 16. The urging of the lip 22″ into the recess 16 is continued until, with the limb 23 in bearing contact with the first side 17 of the recess 16, the apex 31 at the junction between the limbs 23 and 24 of the lip 22″ is in contact with the bottom wall 19 of the recess 16. With the lip 22″ in this position within the recess 16 the free edge 25 of the limb 24 is in biting engagement with the side wall 18 of the recess 16 at a spaced distance from the bottom wall 19 thereof, firmly to restrain the lip 22″ against accidental disassembly of the fence panel 21 from the upper rail 10″, a space 32 being provided between the limb 24 and the bottom wall 19 of the recess 16. Preferably, the side wall 18 of the recess 16 is of concave, shallow V-shaped form with the free edge 25 of the limb 24 being in said biting engagement with the side wall 18 of the recess 16 substantially at the apex 33 of this concave V-shaped form, as shown in full lines in FIG. 3. However, as shown in chain-dotted lines in FIG. 3, if, for example, the width of the limb 24 of the lip 22″ is of a slightly greater or lesser dimension the free edge 25 of this limb 24 will still be in biting engagement with the side wall 18 of the recess 16 at a spaced distance from the bottom wall 19 but on one or other side of the apex 33 of the concave, V-shaped form of this side wall 18, assuming of course that the dimensions of the remaining elements of the lip 22″ and of the recess 16 remain unchanged. Thus, it is an important advantage of the present invention that the free edge 25 of the limb 24 is in biting engagement with the side wall 18 of the recess 16 within a predetermined range of manufacturing tolerances for the dimensions of the elements of the lip 22″ and of the recess 16, thereby avoiding any looseness which could result in rattling of the lip 22″ within the recess 16.

The manner of mounting the lower lip 22′ within the recess 16 in the appropriate side wall 12 of the lower rail 10′ corresponds to the above-described manner of mounting the upper lip 22″ within the recess 16 in the appropriate side wall 12 of the upper rail 10″.

Figure 4:
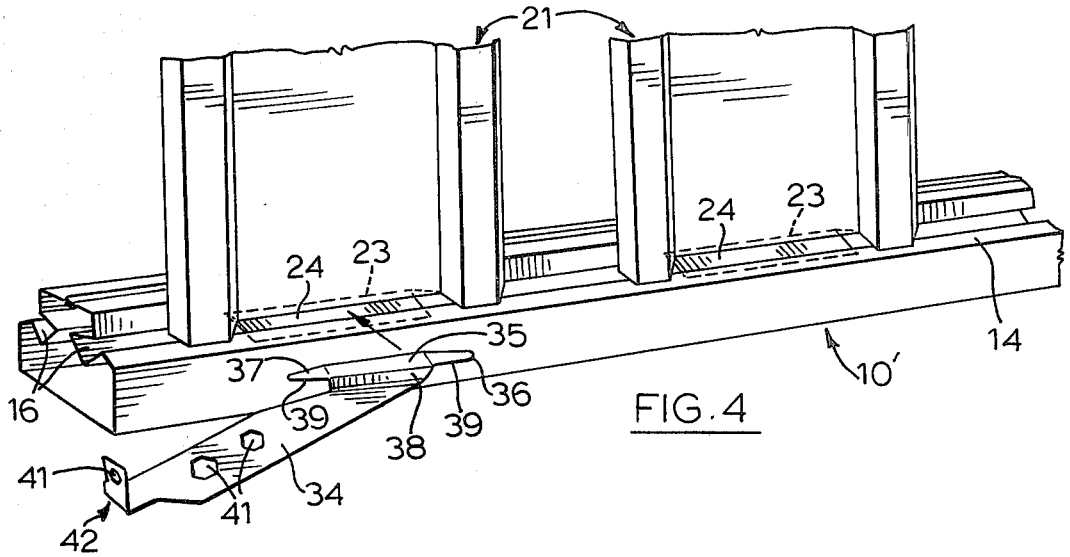
FIGS. 4, 5 and 6 are perspective views of successive steps in a method of disassembling the fence structure shown in the preceding views.

In order, if required, to disassemble the fence panels 21 from the rails 10′ and 10″ for subsequent re-assembly of the fence structure in a different location or merely for repositioning of the fence panels 21 there is provided a joint disassembly tool which, as is most clearly shown in FIG. 4, preferably comprises a shank portion 34 at one end of which there is provided a portion 35 presenting a projection 36 and preferably also a further projection 37 oppositely directed relative to the projection 36. The portion 35 of the tool is in a plane which is parallel to but spaced from the plane of the shank portion 34, an inclined portion 38 being disposed between the shank portion 34 and the portion 35, with the projections 36 and 37 being inclined from the portion 35 towards the plane of the shank portion 34 i.e. being downwardly inclined from the portion 35 with reference to the orientation of the tool as shown in FIG. 4.

To disassemble each fence panel 21 from the rails 10′ and 10″ the lower lip 22′ is preferably first disengaged from the recess 16 in the appropriate side wall 12 of the lower rail 10′, and thereafter the upper lip 22″ is disengaged from the recess 16 in the appropriate side wall 12 of the upper rail 10″. To disengage the lower lip 22′ the portion 35 of the tool presenting the projections 36 and 37 is disposed within the appropriate recess 16 adjacent to the lower lip 22′ to be disengaged, as shown by the arrow in FIG. 4. If there is a fence panel 21 located at this position adjacent to the lower lip 22′ to be disengaged, as is the case shown in FIG. 4, this will result in the portion 35 of the tool being disposed between the limbs 23 and 24 of the lower lip 22′ of this adjacent fence panel 21. The tool is then slidably moved in the direction of the arrow A shown in FIG. 5 to dispose the projection 36 within the space 32 under the limb 24 of the lower lip 22′ to be disengaged, as shown in FIG. 6, parts of the edges of the projections 36 and 37 which are adjacent to the lips of these projections 36 and 37 being in sliding contact substantially with the longitudinally extending corner of the recess 16 defined by the bottom wall 19 and the side wall 18, with the edge portions 39 of the projections 36 and 37 on the sides thereof adjacent to the portion 38 being in sliding contact with the portion of the side wall 18 immediately adjacent the longitudinally extending corner 40 defined by the side wall 18 and the portion 14 of the appropriate side wall 12, and with the portion 38 of the tool spaced slightly from this portion 14 of the appropriate side wall 12, so that any scraping caused by the tool during the slidable movement thereof and which could detract from the appearance of the rail 10′ particularly if the rail 10′ has a paint coating occurs only within the recess 16 where it is relatively unnoticeable, and in particular does not occur on the portion 14 of the side wall 12.

Figure 6:
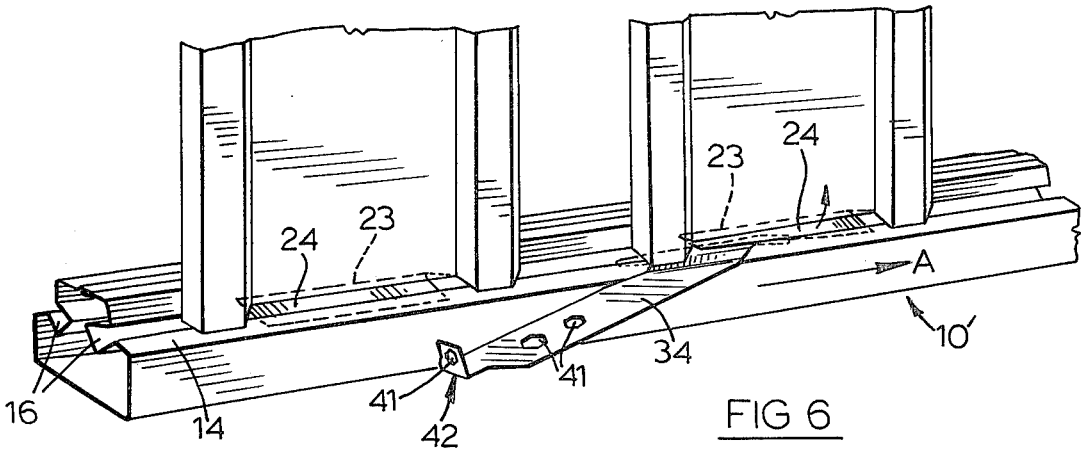

Continued sliding movement of the tool in the direction of the arrow A results in the limb 24 of the lower lip 22′ to be disengaged being pried by the projection 36 resiliently to deform this limb 24 towards the limb 23 of the lower lip 22′ to be disengaged, as clearly shown in FIG. 6. Once the tool has been so slidably moved in the direction of the arrow A a sufficient distance resiliently to deform the entirety of the limb 24 towards the limb 23 the lower lip 22′ to be disengaged is removed from the associated recess 16.

Figure 5:
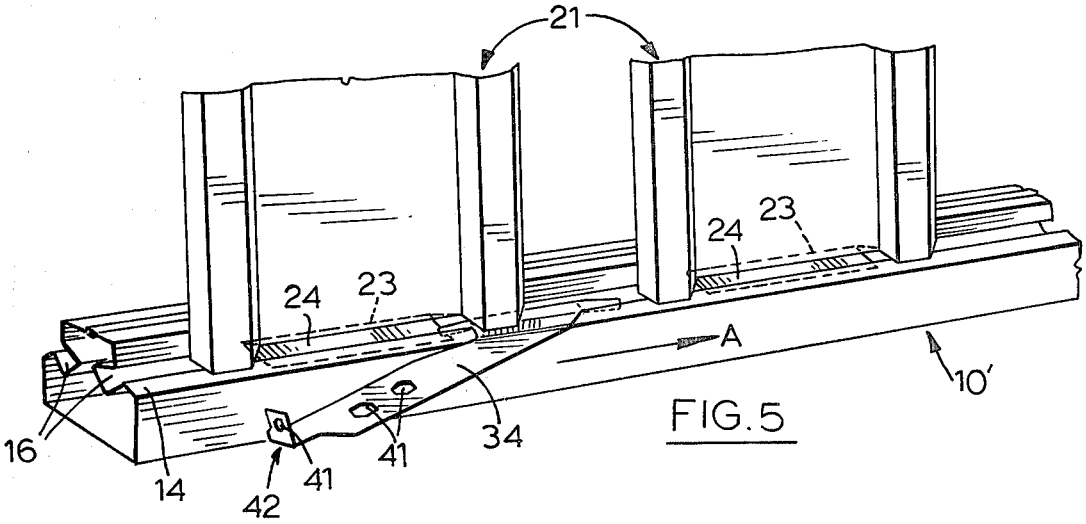

Thereafter, the upper lip 22″ of the fence panel 21 is likewise disengaged from the recess 16 in the appropriate side wall 12 of the upper rail 10″ in a manner corresponding to the above-described disengagement of the lower lip 22′ from the recess 16 in the appropriate side wall 12 of the lower rail 10′, except that as will be appreciated whereas for disengagement of the lower lip 22′ is slidably moved from left to right as viewed in FIGS. 4, 5 and 6, for disengagement of the upper lip 22″ by the projection 36 the tool is used in an inverted condition and is slidably moved from right to left.

The projection 37 is provided to permit disengagement of the lips 22′ and 22″ of the fence panels 21 by means of the projection 37 where it is awkward or inconvenient for this disengagement to be accomplished by the projection 36. As will be appreciated, disengagement of the lips 22′ and 22″ by means of the projection 37 involves slidable movement of the tool in the direction opposite to that hereinbefore described where the disengagement is by means of the projection 36. The edge portions 39 of the projections 36 and 37 are preferably smoothly deflected in the direction away from the plane of the shank portion 35 i.e. upwardly as viewed in FIGS. 4, 5 and 6, thereby to avoid any tendency for these edge portions 39 bitingly to engage, and to minimize the tendency for these edge portions 39 to scrape, the portion of the associated side wall 18 adjacent to the corner 40 during the hereinbefore described sliding movement of the tool. This smooth deflection of the edge portions 39 may extend along the edge portions of the portion 38 and the edge portions of the adjacent part of the shank portion 34 of the tool.

While as hereinbefore described the rails 10′ and 10″ and the end posts 27 are interconnected by the sheet metal screws 30, it will be understood that in alternative embodiments (not shown) these screws 30 may be replaced by nut and bolt assemblies, hexagonal openings 41 being provided in the shank portion 34 of the joint disassembly tool and in an angled end portion 42 of this shank portion 34 to permit the tool to serve as a spanner for tightening, or slackening of these nut and bolt assemblies. Furthermore, the angled end portion 42 of the shank portion 34 of the tool may be of a reduced width which corresponds to the recommended spacing between adjacent fence panels 21 in a single-faced fence structure, so that this end portion 42 may be used as a spacer between adjacent fence panels 21 in the assembly of such a single-faced fence structure.

While as hereinbefore described jointed structures according to the present invention are incorporated in a fence structure it will be understood that these jointed structures may alternatively be incorporated in many different forms of structures such as, for example, ceiling structures or wall structures.

I claim:

1. In combination, a first member having a recess bounded by a bottom wall, a first side wall, and a second side wall, and a second member presenting a resiliently deformable V-shaped lip one limb of which is presented by the second member and the other limb of which has a free edge, the lip being adapted by resilient deformation of said other limb of the lip towards said one limb of the lip to enter the recess in the first member and to attain a position therein in which the lip is in contact with the bottom wall of the recess with a space provided between said other limb of the lip and the bottom wall of the recess, and with said one limb in bearing contact with the first side wall and the free edge of said other limb in biting engagement with the second side wall at a spaced distance from the bottom wall.

2. A jointed structure comprising a first member provided with a recess, and a second member presenting a resiliently deformable lip which is disposed, with the lip resiliently deformed within the recess in the first member with a space provided between the lip and a bottom wall of the recess, and with a free edge of the lip in biting engagement with a side wall of the recess at a spaced distance from the bottom wall thereof.

3. A jointed structure comprising a first member having a recess bounded by a bottom wall, a first side wall, and a second side wall, and a second member presenting a resiliently deformable V-shaped lip one limb of which is presented by the second member, and the other limb of which has a free edge, the lip being disposed, with said other limb of the lip resiliently deformed towards said one limb of the lip, within the recess in the first member and in a position in which the lip is in contact with the bottom wall of the recess with a space provided between said other limb of the lip and the bottom wall of the recess, and with said one limb in bearing contact with the first side wall and the free edge of said other limb in biting engagement with the second side wall at a spaced distance from the bottom wall.

4. A jointed structure according to claim 3, wherein the second side wall of the recess is of concave, shallow V-shaped form, the free edge of said other limb of the lip being in said biting engagement with said second side wall substantially at the apex of said concave V-shaped form.

5. A jointed structure according to claim 3, wherein the first and second side walls of the recess in the first member are divergent in the direction towards the bottom wall of the recess.

6. A fence structure comprising a lower substantially horizontal rail, an upper substantially horizontal rail spaced above the lower rail, and a fence panel connected to the lower rail and to the upper rail, the connection between the fence panel and the lower rail comprising a jointed structure according to claim 3 and in which said first member is constituted by the lower rail and said second member is constituted by the fence panel, and the connection between the fence panel and the upper rail comprising a further jointed structure according to claim 4 and in which said first member is constituted by the upper rail and said second member is constituted by the fence panel.

7. A combination according to claim 1, further comprising a joint disassembly tool which comprises a shank portion at one end of which is provided a projection adapted to enter said space between the lip and the bottom wall of the recess for permitting resilient deformation of the lip, by prying the lip with said projection, to remove the lip from the recess in the first member.

8. A combination according to claim 1, further comprising a joint disassembly tool which comprises a shank portion at one end of which is provided two oppositely directed projections each of which is adapted to enter said space between the lip and the bottom wall of the recess for permitting resilient deformation of the lip, by prying the lip with the projection, to remove the lip from the recess in the first member.

* * * * *